United States Patent [19]

Sitek et al.

[11] 4,419,754

[45] Dec. 6, 1983

[54] FURNACE ELECTRODE

[75] Inventors: George J Sitek; Roger L. Bredeweg, both of Stevensville, Mich.

[73] Assignee: Leco Corporation, St. Joseph, Mich.

[21] Appl. No.: 355,212

[22] Filed: Mar. 5, 1982

[51] Int. Cl.[3] ..... H05B 3/00

[52] U.S. Cl. ..... 373/118; 219/427

[58] Field of Search ..... 373/118; 219/427

[56] References Cited

U.S. PATENT DOCUMENTS 3,936,587 2/1976 Sitek et al. ..... 373/118

4,056,677 11/1977 Berk et al. ..... 373/118

*Primary Examiner*—Roy N. Envall, Jr.

*Attorney, Agent, or Firm*—Price, Heneveld, Huizenga & Cooper

[57] ABSTRACT

An electrode assembly includes an electrode and a crucible-supporting insert releasably secured to the electrode. In the preferred embodiment a collar is threaded onto the electrode and has tabs extending inwardly to clamp the insert to the electrode. A small button-like projection on the electrode may be provided and is received within an aperture in the insert to center the insert on the electrode.

23 Claims, 5 Drawing Figures

FURNACE ELECTRODE

BACKGROUND OF THE INVENTION

The present invention relates to furnaces of the type employed for heating a sample positioned in a resistance crucible held between a pair of electrodes.

In resistive furnaces used as part of an analyzing instrument, a pair of opposed electrodes is provided, between which there is positioned an electrically resistive, graphite crucible into which a specimen to be analyzed is inserted. During operation, one of the electrodes is moved toward the other so that the crucible is clamped between the two electrodes. When electrical current is passed through the clamped crucible, its temperature rises to approximately 2500° C., thereby fusing the sample. An example of such a furnace is shown by U.S. Pat. No. 3,936,587, issued Feb. 3, 1976, to Sitek et al and assigned to the present assignee.

During the course of running specimens through the furnace, the electrodes become contaminated by the byproducts of combustion. It, therefore, becomes necessary after the running of a few specimens to clean the contaminated electrode surfaces. To facilitate cleaning, an upper electrode has been positioned within a demountable housing. This housing can then be removed to facilitate cleaning, such a device being disclosed in U.S. Pat. No. 4,056,677, issued Nov. 1, 1977, to Berk et al and assigned to the present assignee.

Present furnaces make use of disc-like electrode inserts made up of an electrically conductive, wear resistant material for supporting the crucible in the furnace. These inserts are silver soldered to the crucible contacting surfaces of the electrodes. This construction is also disclosed in the above identified U.S. Pat. No. 3,936,587. The lower insert has, with continued use, a tendency to fail by flaking, chipping or cracking due to the arcing of electrical current between the crucible bottom and the insert. When the worn or damaged insert is required to be replaced the use of the furnace is delayed while the insert is removed and resoldered. In some furnaces, the entire lower electrode can be removed, however, removal of this electrode requires time and breaks the integrity of the electrode liquid cooling system.

SUMMARY OF THE INVENTION

In order to overcome the deficiencies of existing furnaces, the present invention provides a crucible-supporting electrode insert which is quickly releasably secured to the supporting electrode. Such construction permits easy removal of the insert and, therefore, easy replacement of the insert without requiring the insert to be unsoldered and a new insert soldered in place. Such construction, therefore, readily permits replacement of worn or damaged inserts without the use of tools or materials.

In a more specific embodiment of the present invention, an insert is provided for a lower electrode which insert includes a portion which projects upwardly for supporting a crucible. Also provided is a collar having spaced inwardly extending tabs which overlie the insert and which collar is secured to the lower electrode so that the tabs securely couple the insert to the electrode.

These and other features, objects and advantages of the present invention will become apparent upon reading the following description thereof together with reference to the drawings in which:

DETAILED DESCRIPTION OF THE PREFERRED EMBODIMENT

Figure 1:
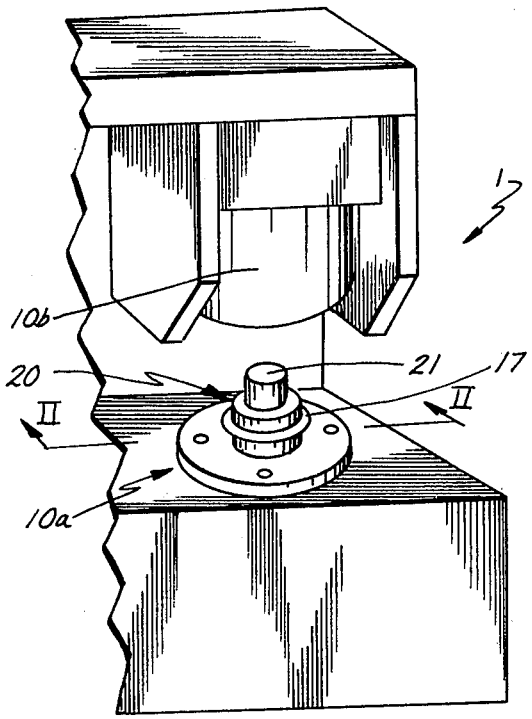
FIG. 1 is a fragmentary perspective view of a resistance heating furnace embodying the present invention.

Included in the preferred embodiment is a resistance heating furnace 1 having lower and upper mating conductive electrodes 10*a* and 10*b*, respectively. An electrically resistive crucible 21' is supported upon lower electrode 10*a* which is movably carried on an actuation mechanism such as a pneumatic cylinder (not shown) which lifts lower electrode 10*a* until it is received by the upper electrode 10*b* and the top of the crucible makes contact with upper electrode 10*b*. The two electrodes 10 do not contact each other at any point other than through an O-ring seal 14 surrounding electrode 10*a* for sealing the combusted gases within the furnace chamber. Electrode 10*b* includes conduit means for introducing a carrier gas into the furnace and also for carrying the specimen gas from the furnace.

Furnace 1 is generally of the type disclosed and described in U.S. Pat. No. 3,936,587, issued Feb. 3, 1976, to Sitek et al, and assigned to the present assignee, and U.S. Pat. No. 4,056,677, issued Nov. 1, 1977, to Berk et al and assigned to the present assignee, the disclosures of which are incorporated herein by reference. Having briefly described the overall furnace system, a detailed description of the crucible supporing lower electrode is presented.

Lower electrode 10*a* is integrally machined of copper and includes a circular flange 16 having counter sunk holes 17' therein for receiving screws attaching the electrode to the raising mechanism of the furnace 1. Around the perimeter of a lower cylindrical end 11 of electrode 10*a* is an annular groove 12 for carrying an O-ring seal 13 for sealing the electrode 10*a* to the underlying support (not shown). Extending upwardly from plate 16 is a generally cylindrical upright portion 14, which extends upwardly a distance sufficient to allow the lower electrode 10*a* to be received within the upper electrode 10*b*.

Formed in the outer wall of upright portion 14 near the top is an annular groove 15 which receives an O-ring 17 (FIG. 1) to seal upper electrode 10*b* to the inner cylindrical wall of electrode 10*b* to seal and confine the gases therebetween. Within upright portion 14 is a recess 18, which during operation, carries a coolant fluid for cooling head 10*a*. Extending upward from upright portion 14 is a generally cylindrical pedestal 19 having a diameter smaller than that of upright portion 14 and having a top annular surface 19' surrounding a small button-like circular protrusion 19''. Pedestal 19 is externally threaded, as indicated at 18'.

Figure 3:
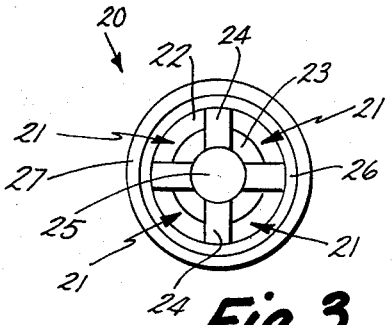
FIG. 3 is a top plan view of the electrode insert.
Figure 4:
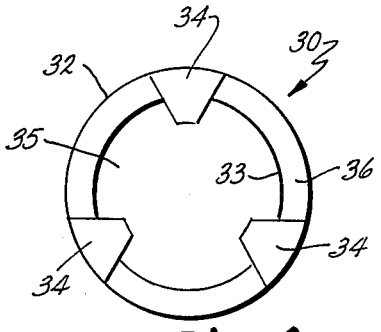
FIG. 4 is a top plan view of the collar.

The electrode insert 20 has a generally circular shape and has a flat annular bottom 21 such that the disc shaped insert 20 can be placed upon the flat upper annular surface 19' of pedestal 19. The insert 20 includes a centrally located aperture 25, extending generally vertically therethrough, with a diameter substantially the same or slightly greater than that of button 19''. This allows the insert to be positioned and centered on the flat surface 19' of pedestal 19 during replacement. The diameter of the insert 20 is about 0.630 inches, so that insert 20 does not extend beyond the edge of pedestal upper surface 19'. Extending upwardly from the upper side of insert 20 are four arcuate segmented projections 21, (FIG. 3) which support a crucible during testing. The projections have a chamfer 22 to form a reduced diameter flat, segmented, annular top surface 23 which supports the crucible floor and provides an electrical contact therewith. Four shallow, rectangular channels 24, spaced at 90° intervals, separate projections 21. Encircling projections 21 is an annular shoulder 26 which is continuous around the outer edge of projections 21. Shoulder 26 has a chamfered outer edge 27 which is a continuation of chamfer 22. At the shoulder 26, the insert 20 is about 0.065 inches thick, and at the flattened, segmented, annular top surface 23 the disc is about 0.125 inches thick. The outer edges of projections 21 form a segmented, annular ridge on the upper surface of the insert having an outer diameter of 0.440 inches and this inner edge has a diameter of about 0.31 inches. Aperture 25 is about 0.185 inches in diameter.

Figure 2:
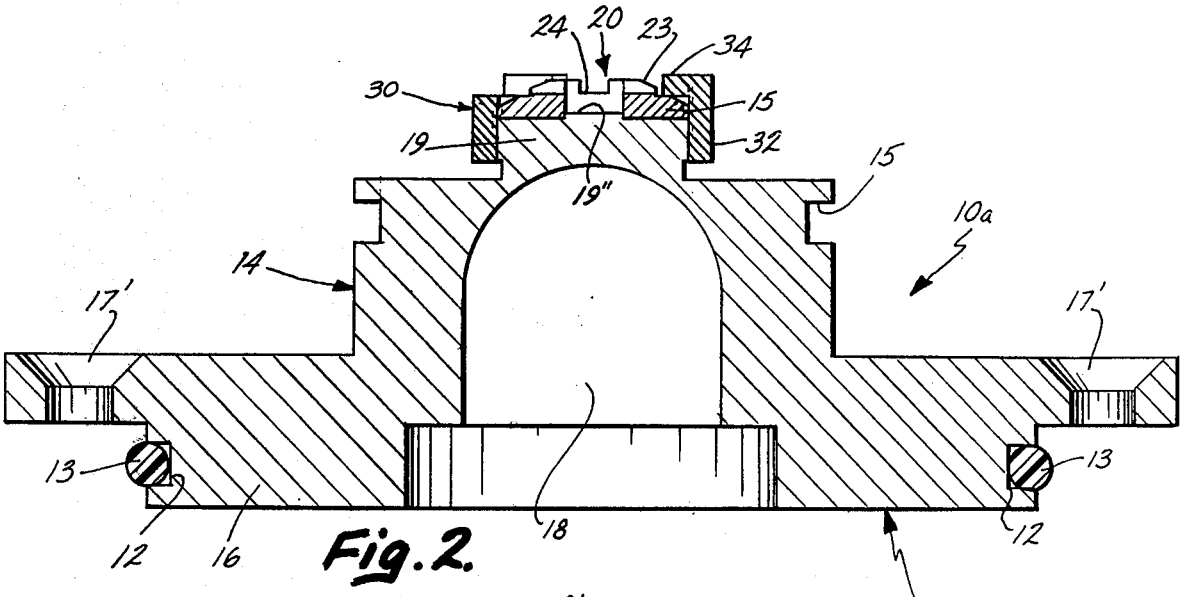
FIG. 2 is an enlarged vertical, cross-sectional view of the lower electrode assembly shown in FIG. 1.
Figure 5:
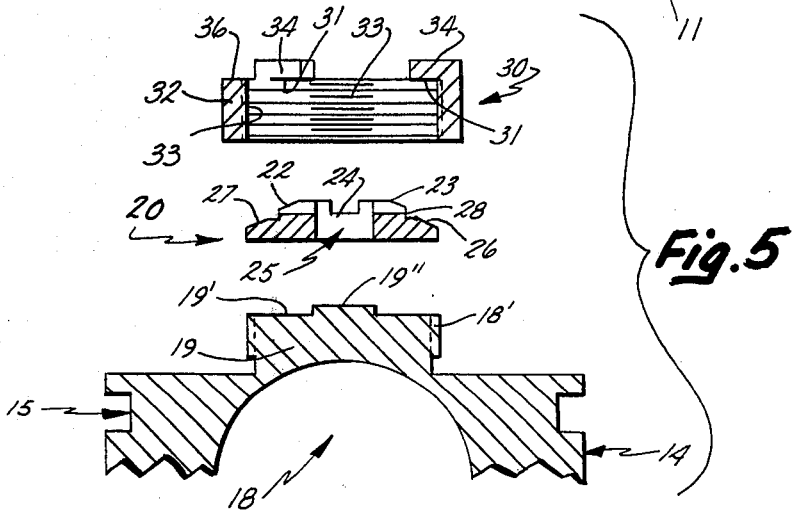
FIG. 5 is an exploded, sectional view of the assembly shown in FIG. 2.

Collar 30 is employed in the preferred embodiment to clamp the insert to the electrode. The collar comprises a cylindrical ring having a wall 32 internally threaded at 33 to screw onto threaded projection 19. The upper edge 36 of collar 30 includes three equally spaced, inwardly extending tabs 34 spaced 120° apart on the perimeter of ring 31. Tabs 34 extend radially toward the central axis of collar 30 and project over aperture 35 of the center of ring 31. The outer surface 36 of ring 31 is knurled to provide a gripping surface, with the outer diameter of collar 30 being about 0.813 inches prior to being knurled. Ring 31 is about 0.194 inches high and has an inside diameter which allows pedestal 19 to be threadably received within aperture 35. Tabs 34 are 0.1725 inches long from outer wall 36 to their innermost point. The angular width of each of tabs 34 encompasses about 20°, and the tabs are inwardly tapered from the outer to inner edges. The tabs have a flat, lower surface 31 and their length is selected to extend closely adjacent cylindrical wall 28 of insert 20 and overlie annular surface 26, as best seen in FIG. 2.

Insert 20 is a sintered piece, pressed from an electrically conductive material, preferably a mixture of 75% tungsten and 25% copper. Other materials such as molybdenum, tanalum, or alloys other than tungsten may also be employed as the insert material, although for some applications, these materials interfere with the specimen gas and would not be suitable. It is preferable to use a tungsten-copper mixture. In selecting the insert material the physical properties which determine the acceptability of the material includes its thermal and electrical conductivity, melting temperature, hardness, wet-ability, machineability and the reactivity, if any, with the specimen gas to be analyzed. Collar 30 is manufactured of stainless steel by standard metal working techniques.

To replace the insert, the cooled insert is removed by unscrewing collar 30 and removing it from pedestal 11. The old insert 20 can then be easily removed from pedestal 13 for reshaping, cleaning or replacement. A replaced or repaired insert 20 is centered on flat upper surface 19' of pedestal 13 with button 19'' extending into aperture 25. Insert 20 is readily centered on pedestal 13 by placing the insert on the pedestal (not necessarily with stud 18 positioned in aperture 25) and sliding the insert around until the insert "pops" onto projection 19'' which maintains insert 20 in position while being secured to electrode **10*a*. As collar 30 is screwed onto threaded area 14, tabs 34 eventually engage shoulder 26 and secure insert 20 to electrode 10*a*. Collar 30 also centers insert 20 on pedestal 19 such that the optional button-like projection 19'' which is helpful, is however, not essential. The collar exerts a compressive force on insert 20 and electrode 10*a*** such that the insert is electrically and mechanically secured thereto.

A crucible of the type similar to that disclosed in U.S. Pat. No. 3,899,627 is placed on top of the insert and rests on the flattened upper surface 23 of projections 21. Due to the shape of a crucible and projections 21, tabs 34 do not contact the crucible at any point. Thus, the electrode tip or insert of the present invention is manually removably secured to the electrode body without using special tools and without welding or soldering, thereby significantly speeding replacement of the tip.

It will become apparent to those skilled in the art that various modifications, such as a change in the number of tabs or in the number of projections, can be made. These and other modifications can be made without departing from the spirit or scope of the present invention as defined by the appended claims.

The embodiments of the invention in which an exclusive property or privilege is claimed are defined as follows:

1. An electrode assembly for use on one or more electrodes of a resistance furnace used for heating resistive crucibles for the fusion of small analytical samples contained therein, said assembly comprising:

an electrically conductive electrode body having a surface facing generally toward a crucible to be heated by the electrode and shaped to receive an insert; and an electrically conductive insert made of a wear-resistant material and having a mating surface to said surface of said electrode, said assembly including collar means threadably engaging said electrode body for mechanically and removably securing said insert to said electrode in electrical contact therewith.

2. The apparatus as defined in claim 1 wherein said surface and said mating surface are substantially flat.

3. The apparatus as defined in claim 2 wherein said surface and said mating surface are annular.

4. The apparatus as defined in claim 3 wherein said electrode surface includes an outwardly extending button-like projection for centering said insert on said electrode and wherein said insert includes an aperture for receiving said button-like projection to align said insert with respect to said electrode.

5. For use in a furnace for heating an electrically resistive crucible, an electrode assembly comprising:

an electrode having a support area made of an electrically conductive material;

an insert made of an electrically conductive material and having a surface shaped to engage and electrically contact said support area, said insert shaped to engage an electrically resistive crucible; and collar means threadably engaging said electrode for releasably, mechanically and electrically coupling said insert to said support area with said surface contacting said support area.

6. The apparatus as defined in claim 5 and further including means for centering said insert on said support area.

7. The apparatus as defined in claim 5 wherein said support area is annular and said surface of said insert is annular.

8. For use in a furnace for heating an electrically resistive crucible, an electrode assembly comprising:

an electrode having an annular support area made of an electrically conductive material;

an insert made of an electrically conductive material and having an annular surface shaped to engage and electrically contact said support area, said insert shaped to engage an electrically resistive crucible;

means for releasably, mechanically and electrically coupling said insert to said support area with said surface contacting said support area; and wherein said coupling means comprises an attaching element contacting a side of said insert remote from said electrode and which is removably secured to said electrode.

9. The apparatus as defined in claim 8 wherein said electrode has a threaded cylindrical area on a side adjacent said support area and said attaching element has a threaded area disposed to threadably secure said element to said electrode.

10. The apparatus as defined in claim 9, wherein said attaching element is a collar having tab means extending toward the central axis of said collar such that said tab means contacts a portion of the remote side of said insert when said collar is threadably secured to said electrode.

11. The apparatus as defined in claim 10, wherein said insert has a projecting portion which extends upwardly for seating a crucible in a position on said insert remote from said collar and tab means thereon.

12. The apparatus as defined in claim 11, wherein said insert has an annular shoulder on said remote side encircling said projecting portion, and said tab means contacts said shoulder.

13. The apparatus as defined in claim 12, wherein said tab means comprises three equally spaced, inwardly projecting tabs.

14. In a resistance heating furnace for heating an electrically resistive crucible for analytical samples said crucible held between two electrodes, the improvement comprising:

one of said electrodes having a support area;

an insert made of an electrically conductive material; and collar means threadably engaging said one of said electrodes for releasably securing said insert to said support area so that the insert can be manually, quickly and easily secured to or removed from said support area.

15. The apparatus as described in claim 14, wherein said collar means contacts both said insert and said electrode.

16. In a resistance heating furnace for heating an electrically resistive crucible for analytical samples said crucible held between two electrodes, the improvement comprising:

one of said electrodes having a support area;

an insert made of an electrically conductive material;

means including an attaching element which contacts both said insert and said electrode for releasably securing said insert to said support area so that the insert can be manually, quickly and easily secured to or removed from said support area; and wherein said insert has an upper side and said support area has an adjacent sidewall and wherein said attaching element contacts a portion of said upper side of said insert and contacts said sidewall of said support area to securely and releasably secure said insert to said support area.

17. The apparatus as defined in claim 16, wherein said support area has a threaded area on said sidewall and said attaching element has an inner wall to define an aperture therein, said inner wall having a threaded area to receive the threaded area of said support area.

18. The apparatus as described in claim 17, wherein, said attaching element is a collar having at least one tab extending from said collar near the top and toward the center axis of said collar to contact a portion of the upper side of said insert when said attaching element is threaded onto said support area.

19. The apparatus as described in claim 18, wherein said insert has a projecting portion which extends upwardly for seating the crucible out of contact with said tab.

20. The apparatus as described in claim 19, wherein said insert has an annular shoulder on the upper side encircling said projecting portion, and said tab contacts said shoulder.

21. The apparatus as described in claim 15, wherein said collar means has three equally spaced tabs for engaging an upper surface of said insert.

22. The apparatus as described in claim 21 and further comprising means for centering said insert in said support area.

23. The apparatus as described in claim 22, wherein said support area of said electrode has a centering projection thereon and said insert includes an aperture therein for receiving said centering projection.

* * * * *